US005529225A

United States Patent [19]

Chang

[11] Patent Number: 5,529,225

[45] Date of Patent: Jun. 25, 1996

[54] CONSTRICTED SPRING PRESSURE RELIEF MECHANISM FOR DRIPLESS DRIVE CAULK DISPENSING DEVICES

[76] Inventor: Peter J. Chang, 11001 Petersborough Dr., Rockville, Md. 20852

[21] Appl. No.: 491,119

[22] Filed: Jun. 16, 1995

Related U.S. Application Data

[60] Division of Ser. No. 296,647, Aug. 26, 1994, which is a continuation-in-part of Ser. No. 205,655, Mar. 4, 1994, Pat. No. 5,381,931.

[51] Int. Cl.[6] ..... B67D 5/42

[52] U.S. Cl. ..... 222/391

[58] Field of Search ..... 222/391, 137, 222/325, 309

[56] References Cited

U.S. PATENT DOCUMENTS

| | | | |
|---|---|---|---|
| 4,081,112 | 3/1978 | Chang | 222/391 |
| 4,461,407 | 7/1984 | Finnegan | 222/391 |
| 4,706,853 | 11/1987 | Stonesifer et al. | 222/391 |
| 5,156,305 | 10/1992 | Eyre | 222/391 X |
| 5,192,008 | 3/1993 | Hwan | 222/391 |
| 5,197,635 | 3/1993 | Chang | 222/137 |
| 5,381,931 | 1/1995 | Chang | 222/309 |

*Primary Examiner*—Gregory L. Huson

*Attorney, Agent, or Firm*—Law Offices of Royal W. Craig

[57] ABSTRACT

A simple and economical drive mechanism for caulk dispensing devices that gives a dripstop release feature to improve control over the bead of caulk. The drive mechanism is shown in the context of an open frame housing (which may be a single piece of molded plastic) having a downwardly extending handle. A plunger shaft is slidably supported in the housing for dispensing caulking composition, and a trigger is pivoted to the housing and retractable against the handle. The trigger includes an upper portion extending above the plunger shaft. A first gripping member encircles the plunger shaft forwardly of the trigger and protrudes downward for engagement with the trigger when the trigger is retracted. A first compression spring rearwardly biases the first gripping member, the first compression spring being formed with a forward constricted end having increasingly tighter helical coils to frictionally grip the plunger shaft. Upon retraction of the trigger, the first grip drives the plunger shaft to overcome the friction of the constricted end of the first compression spring and the plunger shaft slides on through. Upon release the first gripping member and compression spring are able to retreat a bit until blocked by the frame. At that point the constricted end of the spring grips the plunger shaft and prevents further retraction, thereby cutting off the flow of caulk. This provides a dripless release feature by relieving pressure in the cartridge upon initial release of the trigger.

1 Claim, 3 Drawing Sheets

CONSTRICTED SPRING PRESSURE RELIEF MECHANISM FOR DRIPLESS DRIVE CAULK DISPENSING DEVICES

CROSS-REFERENCE TO RELATED APPLICATION(S)

The present application is a divisional of U.S. Ser. No. 08/296,647, filed Aug. 26, 1994, which is a continuation-in-part of Ser. No. 08/205,655, filed Mar. 4, 1994, and issued as U.S. Pat. No. 5,381,931.

FIELD OF THE INVENTION

The present invention relates to dispensing devices and, more particularly, to drive mechanisms for hand-held caulk guns that include a dripless feature to release built-up pressure from the cartridge upon release of the trigger.

BACKGROUND OF THE INVENTION

Conventional economy brand caulking guns are generally manual trigger-operated devices incorporating a unidirectional gripping assembly which urges a piston rod forward to eject the compound from a cartridge. One such caulk gun is set forth in U.S. Pat. No. 4,081,112 issued to Chang. The Chang '112 caulking gun positions the trigger pivot and trigger drive grip engagement above the plunger shaft. This improvement increases the leverage obtainable by a hand operated trigger and allows robust delivery of the composition at a higher volume and flow rate than was previously possible in a hand-held caulking gun. This helps to deliver a variety of dense fluid compounds including urethane, vinyl, polyester, epoxy and other plastics or resins.

In addition to their density, many of these compounds have other properties such as fast setting times that make them difficult to remove if improperly applied. Consequently, in addition to being robust, the dispensing device must be capable of applying a clean and uniform bead of compound. In large part, the quality of the bead depends on the users ability to control the volumetric flow rate. Optimally, control should be maintained at all times to insure a uniform bead. However, complete control is difficult in light of the different densities of material to be applied, and the different conditions encountered during application. Control is often lacking when the user wishes to terminate or reduce the bead of caulk. Most prior art caulk guns maintain full pressure when the trigger is released, and the user is required to depress a release lever to terminate the bead. This introduces a short lag time between the decision to terminate or reduce the bead and depression of the release lever. Within this lag time of maintained pressure, an unwanted surplus of compound is extruded and a messy and uneven bead often results. It would be best if pressure could be relieved upon initial release of the trigger, thereby cutting off the flow of caulk. However, the plunger must quickly be locked in place to prevent rearward retraction. Otherwise, it will be difficult to continue dispensing of compound in a uniform bead.

There have been past efforts to achieve this momentary releasing action in the past. For example, U.S. Pat. No. 4,566,610 issued to Herb discloses a dual-cartridge dispensing device utilizing a pair of angled grips 16 (see FIG. 1) which engage a releasing member 19 upon full release of the trigger to thereby remove all driving force and free the plunger shafts. Unfortunately, the releasing mechanism of Herb '610 is adapted for that particular drive assembly, and the drive assembly is complex and expensive.

U.S. Pat. No. 4,461,407 to Finnegan discloses an automatic pressure relief mechanism for a caulk gun including an annular elastic ring 42 tightly encircling the plunger shaft 8. The ring 42 is held against the interior of housing 21 by a fixed retainer 200. When the trigger 130 is retracted, the plunger shaft 124 is urged forward through the ring 42. Since it is tight, the ring deforms and is partially pulled through the housing wall 21. When the trigger 130 is released, the deformed ring 42 tries to regain its shape, thereby pulling shaft 124 back a bit. This releases pressure, and a dripstop feature is introduced. Despite the advantage, the Finnegan '407 caulk gun has its drawbacks. Specifically, the attachment of the frictional ring 42 to the wall of housing 21 impedes the motion of the plunger shaft 124. The elastic ring 42 becomes the subject of deformation and wear. Moreover, the ring 42 and retainer 200 assembly is rather costly as it requires intricate metal forming (see FIG. 2), welding (column 4, lines 24–26), and a precision-fit elastic ring (see column 4, lines 63–68). These factors escalate the manufacturing costs.

U.S. Pat. No. 5,156,305 to Eyre discloses a drive assembly for a molded-plastic open frame caulk gun. In this open frame type (see FIG. 2), the plunger shaft is slidably carried by two sleeves 28, 30 formed in a molded plastic housing. A downwardly extending trigger 43 is pivoted to the housing and retractable against the handle 46. The trigger 43 includes an upper rivet 45 above the pivot point. The upper rivet 45 bears against a first gripping member 41 that encircles the plunger shaft, and a compression spring 42 rearwardly biases the first gripping member 41 toward the trigger 43. A release lever 51 encircles the plunger shaft and extends upwardly behind the housing to a pivot point. Like Finnegan '407, Eyre '305 also teaches the use of a rod-engaging O-ring bush 52 that relieves pressure upon release of the trigger. In contrast to Finnegan '407, Eyre '305 attaches the bush 52 to the release lever 51 to move therewith (see, also, column 4, lines 18). The plunger shaft frictionally passes through the elastic bush 52. In operation, the release lever 51 with integral bush 52 rides forward on the plunger shaft while the trigger 43 is retracted. When the trigger 43 is first released, the friction of the bush 52 catches the plunger shaft and the release lever 51 is carried backward. The release lever 51 eventually attains a critical angle and engages the plunger shaft to prevent further retraction. However, pressure is released in the meantime, and a dripstop feature is introduced. As did Finnegan '407, Eyre '305 leaves room for improvement. The bush 52 and housing 53 assembly is rather costly as it requires drilling of a hole through the release lever, insertion of the bush 52 in the housing 53, and insertion of the combination into the release lever hole. The additional parts and labor greatly increases manufacturing costs and assembly time.

It would be advantageous to provide a robust drive assembly at lower manufacturing costs.

SUMMARY OF THE INVENTION

In accordance with the above, it is an object of the present invention to provide simpler, less costly, and more efficient drive assemblies with simple economical drip-stop release mechanisms to improve control over the bead of caulk.

In accordance with the present invention, there is disclosed of a robust drive assembly for manual caulking guns. The drive assembly is shown in the context of an open frame housing (which may be a single piece of molded plastic) having a downwardly extending handle. A plunger shaft is slidably supported in the housing for dispensing caulking composition, and a trigger is pivoted to the housing and retractable against the handle. The trigger includes an upper portion extending above the plunger shaft. A first gripping member encircles the plunger shaft forwardly of the trigger and protrudes downward for engagement with the trigger when the trigger is retracted. A first compression spring rearwardly biases the first gripping member, the compression spring being formed with a forward constricted end having increasingly tighter helical coils to frictionally grip the plunger shaft. In operation, the constricted end of the first compression spring rides forward on the plunger shaft to an extended position where the friction of the coils is overcome. At this point the plunger shaft slides on through. However, when the trigger is released the constricted end of the first compression spring rides backward on the plunger shaft as the first compression spring recoils, thereby providing limited initial release of the plunger shaft and easing pressure. The plunger shaft releases until the first compression spring attains its original position. At this point, the constricted end frictionally engages said plunger shaft to prevent further retraction.

The above-described drive mechanism afford a dripless release feature by relieving pressure in the cartridge upon initial release of the trigger. It is simple and highly effective, and it can be manufactured for a fraction of the cost of existing adjustable-thrust and/or drip-stop caulking guns.

DETAILED DESCRIPTION OF THE PREFERRED EMBODIMENT

Figure 1:
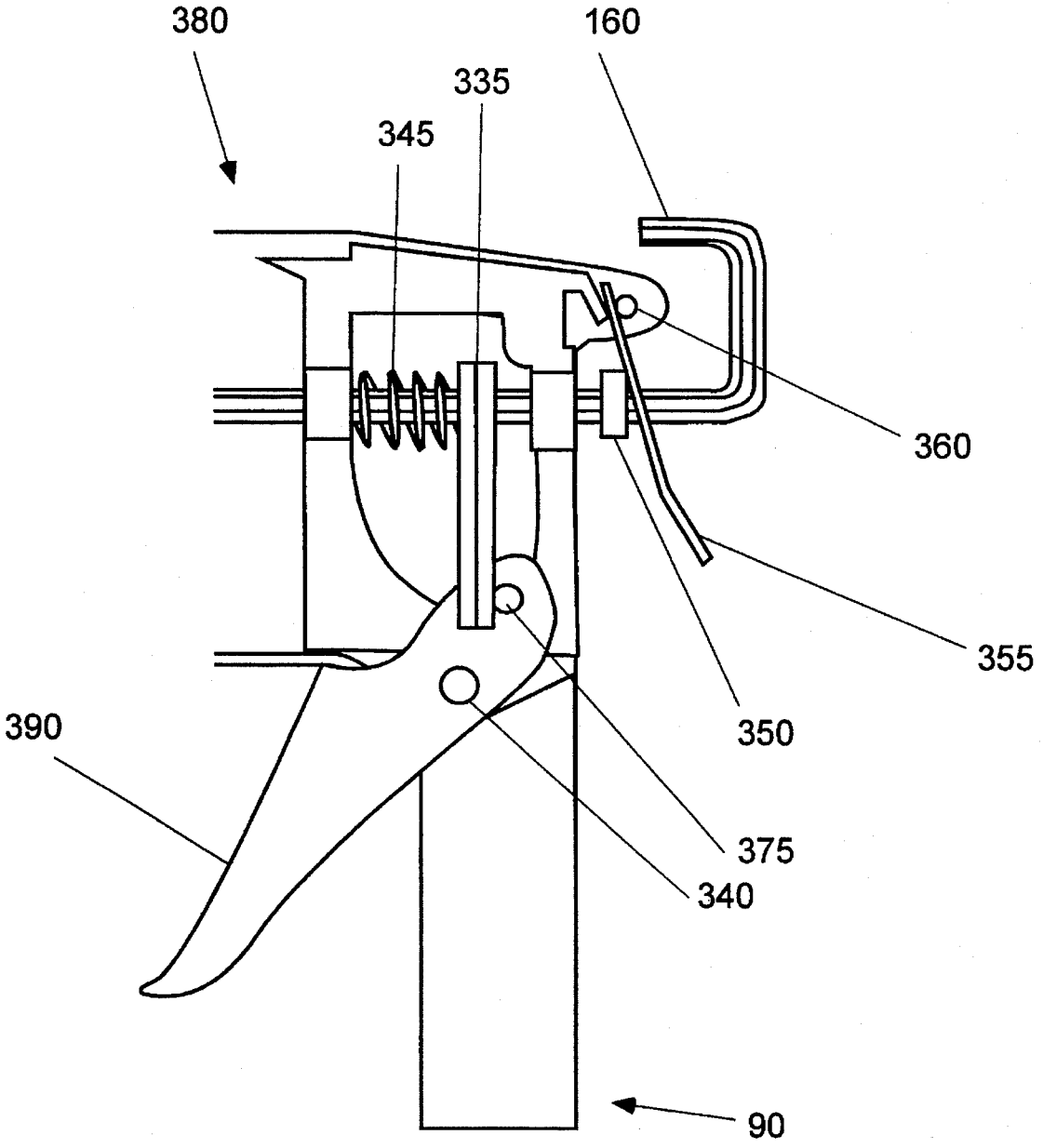
FIG. 1 is a side view of a dripless drive mechanism according to the present invention incorporated in an open frame caulking gun.

FIG. 1 shows a side view of a plunger drive assembly according to the present invention incorporated in an open frame caulking gun.

The caulking gun generally includes an open frame which may be integrally molded of plastic, fiberglass, or other composition. The open frame includes a forward section (not shown) for slidably guiding a piston (not shown) mounted at the distal end of a plunger shaft 160. The forward section may be adapted for carrying a conventional caulk cartridge, or it may be a refillable barrel-type reservoir for containing loose composition. The plunger shaft 160 is driven by a plunger drive assembly carried in a rearward section 380 of the open frame. The drive assembly includes a trigger 390 which is shown pivoted at a screw hinge 340 located below plunger shaft 160. An upper portion of trigger 390 extends past screw hinge 340. The plunger shaft 160 extends through, and is slidably carried within two supporting sleeves formed integral to support assembly 380. Trigger 390 extends upwardly, straddles the rearward section 380 of the frame, and is pivotally fixed to the rearward section 380 of the frame at a screw hinge 340 located below plunger shaft 160. An offset drive pin 375 extends transversely through trigger 390 and bears against the first grip 335. First grip 335 is a flat elongate metal plate having a through-bore near the top edge to pass plunger shaft 160.

The above-described components effect the forward operation of the plunger drive shaft 160. The trigger 390 is retracted by hand and pivots counterclockwise about screw hinge 340. The offset drive pin 375 bears against first grip 335 and urges it forward. As first grip 335 is biased forward from the bottom it reaches a critical angle where it engages plunger shaft 160, and further retraction of trigger 390 is converted into lateral movement of plunger drive shaft 160.

When trigger 390 is released it is return-biased by compression spring 345 acting through first grip 335, and both the first grip 335 and trigger 390 pivot clockwise about pivot 340 to their home position (shown). As first grip 335 moves toward an upright position it releases plunger shaft 160.

A release-lever 355 hangs down against the rearward section 380 of the frame, and release lever 355 serves to lock the plunger shaft 160 against further retraction. Release-lever 355 is formed with a through-bore to encircle plunger shaft 160, and is notched at the top edge to flank the frame. Protruding ribs in the rearward section 3 80 of the frame capture the flanking release-lever 355. The release-lever 355 may be formed from a substantially flat elongate metal member with a through-bore toward the bottom to pass plunger shaft 160.

As explained, it is most desirable to allow plunger shaft 160 to retract very slightly when the trigger 390 is released to remove pressure from the caulk cartridge, thereby cutting off the flow of caulk. This provides a dripless feature. However, plunger shaft 160 must be quickly locked into position to prevent further retraction. Otherwise, the plunger shaft 160 will not be advanced sufficiently with successive trigger retractions to take up the space left by expelled caulk. In the embodiment of FIG. 1 this dripless action is provided by a floating washer 350 which rides on plunger shaft 160 between release lever 355 and the back of support frame 380. As trigger 390 is retracted as described above, the top portion of trigger 390 is pivoted forward and drive pin 375 bears against first grip 335, which in turn engages plunger shaft 160 to drive it forward. During the initial retraction floating washer 350 moves with plunger shaft 160 and is drawn toward support frame 380 until it is stopped thereby. During further retraction the plunger shaft 160 is drawn through washer 350. Upon release of trigger 390, the washer 350 retracts a bit along with plunger shaft 160 (to the extent that it was drawn inward toward support frame 380) to relieve pressure on the caulk cartridge. As the plunger shaft 160 retracts the washer 350 urges release lever 355 outward until it attains the critical angle and again engages shaft 160, thereby locking it against further retraction. The dripless feature is provided by momentarily removing pressure from the caulk cartridge, thereby cutting off the flow of caulk. At any time the release lever 355 can be depressed manually to disengage plunger shaft 160 and allow manual withdrawal thereof to replace a spent caulk cartridge or the like.

Figure 2:
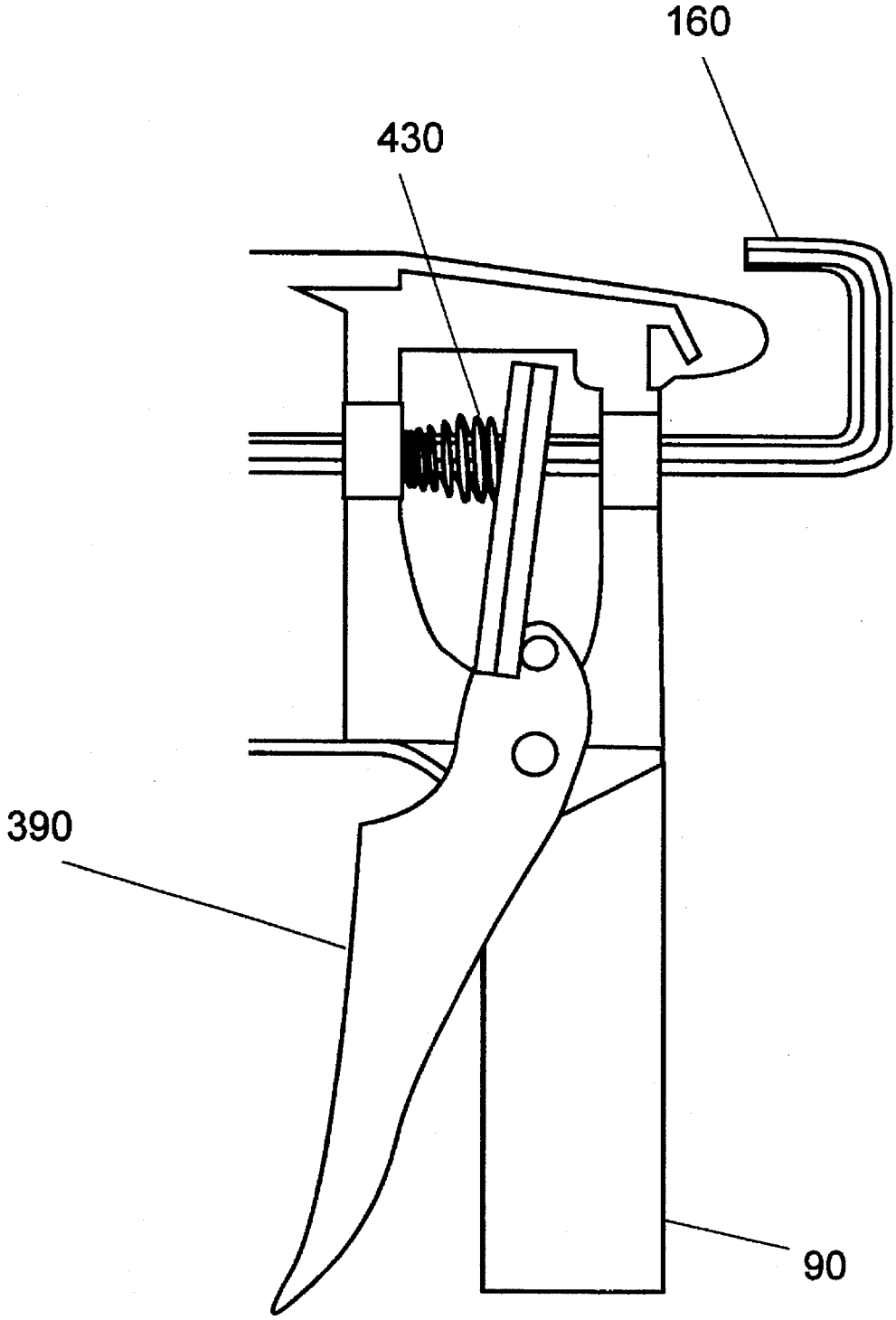
FIG. 2 is a side view of another embodiment of a dripless drive mechanism according to the present invention incorporated in an open frame caulk gun (the mechanism being shown in a retracted position).

FIG. 2 shows a side view of a plunger drive assembly according to another embodiment of the present invention, wherein like components bear the same references as in FIG. 1.

Figure 3:
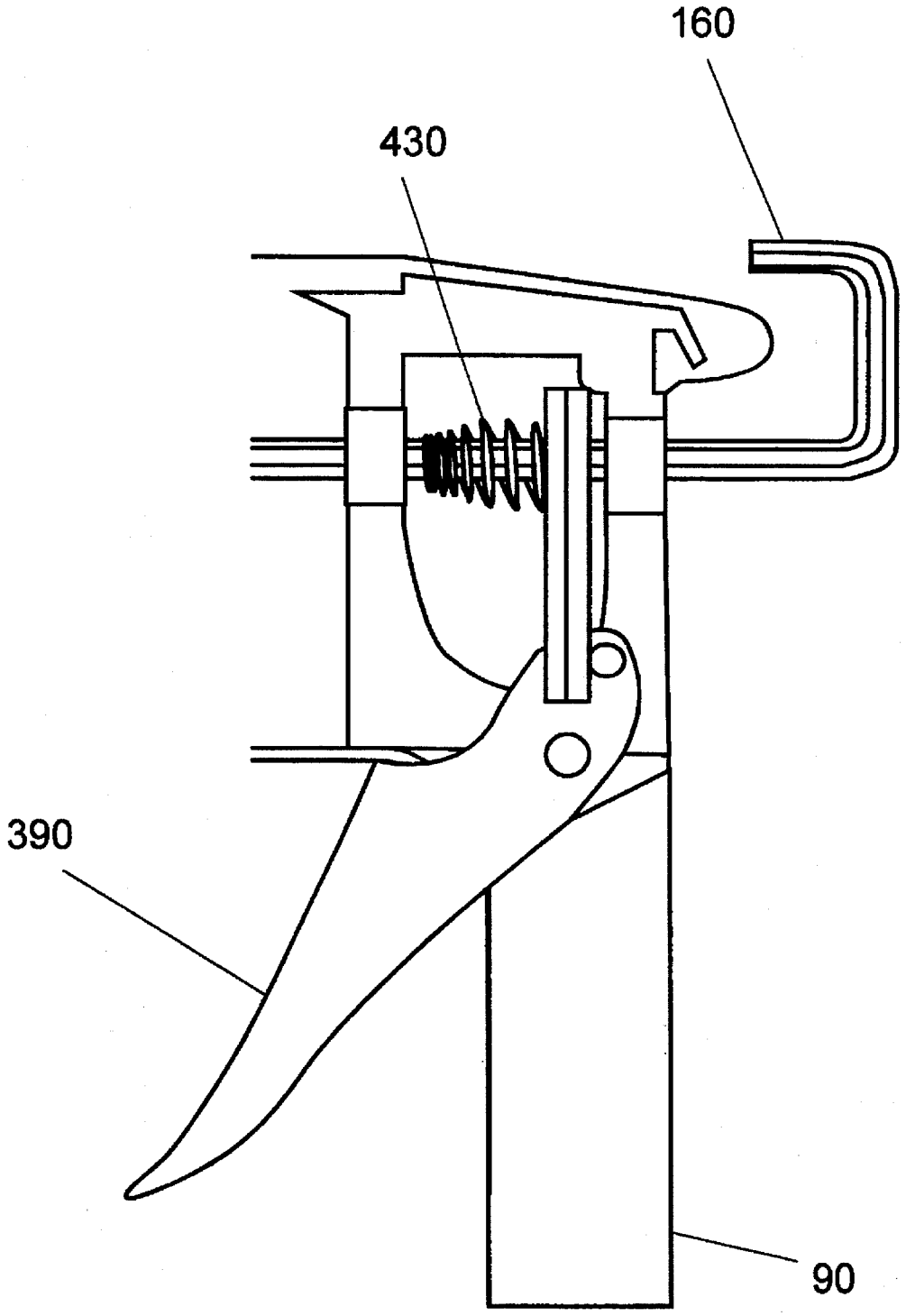
FIG. 3 is a side view of the drive mechanism of FIG. 2 in a released position.

The forward operation of the plunger drive assembly of FIG. 2 is identical to that of FIG. 1. The dripless function of the floating washer of FIG. 1 is performed instead in FIG. 2 by a specially formed spring 430 with a constricted yoke for frictionally gripping the plunger shaft 160. In forward operation, trigger 390 is retracted, the top portion of trigger 390 is pivoted forward, drive pin 375 bears against first grip 335, and grip 355 is rotated clockwise until it reaches a critical angle and engages plunger shaft 160 to drive it forward. During initial retraction the first grip 35 compresses spring 430 against the forward sleeve of the open frame support assembly 380. Plunger shaft 160 overcomes the friction of the yoke and slides on through spring 430. When trigger 390 is released it is return-biased by the action of spring 430 pushing back on the first grip 335, and trigger 390 pivots clockwise about pivot 340 to its home position. First grip 335 moves backward to its home position against support assembly 380. As the top portion of trigger 390 pivots clockwise and out of contact with the first grip 335, first grip 335 moves toward an upright position and releases plunger shaft 160. The plunger shaft is prevented from rearward retraction by the frictional force of the yoke of spring 430. Once again, it is desirable to allow plunger shaft 160 to retract very slightly when the trigger 390 is initially released to remove pressure from the caulk cartridge, thereby cutting off the flow of caulk. This provides a dripless feature. Upon initial release of trigger 390, the plunger shaft 160 is free to retract a bit while grip 335 moves backward to its home position. The constricted yoke of spring 430 maintains its grip on the plunger shaft 160, and the spring 430 rides back thereon following the first grip 335. However, as first grip 335 contacts the rear sleeve of the open frame support assembly 380 it stops retreat of the spring 430. With its yoke still gripping the plunger shaft 160, spring 430 resists further retraction of the plunger shaft 160. This particular embodiment has a number of advantages over the use of an elastic washer. Most importantly, the length by which the plunger shaft 160 is allowed to retract upon initial release of the trigger 390 is very small. While providing the dripless feature, this also prevents undue backtracking, whereby too much pressure is lost from the cartridge. If the plunger shaft is not locked quickly, the user must work much harder (complete more trigger retractions) to extrude the same amount of compound. The embodiment of FIGS. 2 and 3 yields a faster extrusion by as much as 30% compared to the Eyre '305 drive assembly, and this significantly lessens hand fatigue. It also eliminates the need for a second grip or release lever (e.g., ref. 355 of FIG. 1), thereby saving further costs. In addition, the constricted spring is more durable than elastic, and it provides a firmer grip on the plunger shaft. This prevents the shaft from inadvertently sliding out when the gun is angled or hung by the shaft from a ladder.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. A drive assembly for a caulking gun, comprising:

a frame having a downwardly extending handle and a pair of sleeves;

a plunger shaft slidably supported in said frame between said sleeves for dispensing caulking composition;

a trigger pivoted to said frame below said plunger shaft and retractable against said handle, said trigger including an upper portion extending from the pivot toward said plunger shaft;

a first gripping member encircling the plunger shaft forwardly of said trigger and protruding downwardly for engagement with said trigger when said trigger is retracted;

a first compression spring rearwardly biasing said first gripping member, said first compression spring having at least one constricted end formed with increasingly tighter helical coils to frictionally grip said plunger shaft;

whereby upon retraction of said trigger the first gripping member advances the plunger shaft through the constricted end of the first compression spring, and upon release the first gripping member and compression spring retreat until blocked by said frame, said constricted end of said spring then gripping the plunger shaft and preventing further rearward retraction, thereby cutting off the flow of caulk.

* * * * *